US008702067B2

(12) United States Patent
Meijer

(10) Patent No.: US 8,702,067 B2
(45) Date of Patent: Apr. 22, 2014

(54) AXIAL DISPLACEMENT DEVICE, LINE DEPLOYMENT SYSTEM, AND A METHOD FOR DEPLOYING A LINE

(75) Inventor: Peter Marius Meijer, Leimuiden (NL)

(73) Assignee: Heerema Marine Contractors Nederland SE, Leiden (NL)

( * ) Notice: Subject to any disclaimer, the term of this patent is extended or adjusted under 35 U.S.C. 154(b) by 677 days.

(21) Appl. No.: 12/674,086

(22) PCT Filed: Aug. 22, 2008

(86) PCT No.: PCT/NL2008/000195

§ 371 (c)(1),
(2), (4) Date: Feb. 18, 2010

(87) PCT Pub. No.: WO2009/028932

PCT Pub. Date: Mar. 5, 2009

(65) Prior Publication Data

US 2011/0108786 A1 May 12, 2011

Related U.S. Application Data

(60) Provisional application No. 60/957,832, filed on Aug. 24, 2007.

(51) Int. Cl.
*B66F 1/00* (2006.01)

(52) U.S. Cl.
USPC ..... 254/385; 254/278; 254/374

(58) Field of Classification Search
USPC ..... 254/278, 385, 374
See application file for complete search history.

(56) References Cited

U.S. PATENT DOCUMENTS

| | | | | | |
|---|---|---|---|---|---|
| 2,369,467 | A | * | 2/1945 | Kerr | 72/289 |
| 2,620,996 | A | * | 12/1952 | Le Bus | 242/602.2 |
| 2,926,001 | A | * | 2/1960 | Mack et al. | 74/469 |
| 2,948,483 | A | * | 8/1960 | Petersen | 242/419.9 |
| 2,984,455 | A | * | 5/1961 | Fischer | 254/274 |
| 3,075,724 | A | * | 1/1963 | Stahmer | 242/376 |
| 3,402,589 | A | * | 9/1968 | Lathom | 72/289 |
| 3,583,651 | A | * | 6/1971 | Schulze et al. | 242/413 |
| 3,707,275 | A | * | 12/1972 | Arnold | 242/157 R |
| 3,901,479 | A | * | 8/1975 | Arnold | 242/157 R |
| 3,934,854 | A | * | 1/1976 | Goode | 254/134.3 R |
| 4,327,897 | A | * | 5/1982 | Smith | 254/395 |
| 4,460,160 | A | * | 7/1984 | Tillotson | 254/386 |
| 4,795,108 | A | * | 1/1989 | Appling | 242/157.1 |

(Continued)

FOREIGN PATENT DOCUMENTS

| | | | | | |
|---|---|---|---|---|---|
| DE | 1038737 | | 9/1958 | | |
| JP | 05319786 | A * | 12/1993 | | B66D 1/36 |
| WO | WO 0214204 | A1 * | 2/2002 | | B66D 1/38 |

*Primary Examiner* — Emmanuel M Marcelo
*Assistant Examiner* — Michael Gallion
(74) *Attorney, Agent, or Firm* — Hoffmann & Baron, LLP

(57) ABSTRACT

The invention relates to an axial displacement device (3) to be used in conjunction with a rotary winch (2), said winch comprising a drum (7) being rotatable about an axis of rotation (a-a), said axial displacement device to be arranged stationary with respect to said winch and comprising one or more guiding elements (23), said one or more guiding elements being configured to displace a winding of said line in an axial direction parallel to said axis of rotation with at least the diameter of said line, so that a part of said winding being in contact with said drum runs in a plane substantially perpendicular to the axis of rotation.

16 Claims, 4 Drawing Sheets

(56) References Cited

U.S. PATENT DOCUMENTS

| | | | | | |
|---|---|---|---|---|---|
| 4,921,219 | A | * | 5/1990 | Ottemann et al. | 254/284 |
| 5,215,272 | A | * | 6/1993 | Sauber | 242/390.5 |
| 5,230,588 | A | * | 7/1993 | Wittke et al. | 405/191 |
| 5,367,972 | A | * | 11/1994 | McCulloh | 114/253 |
| 5,482,219 | A | | 1/1996 | Tcholakov | |
| 5,829,737 | A | * | 11/1998 | Gersemsky | 254/278 |
| 5,842,257 | A | * | 12/1998 | Tashima et al. | 29/25.01 |
| 5,863,029 | A | * | 1/1999 | Fanger et al. | 254/389 |
| 6,073,917 | A | * | 6/2000 | Plummer | 254/389 |
| 6,561,451 | B1 | * | 5/2003 | Steinich | 242/563.2 |
| 6,641,117 | B2 | * | 11/2003 | Heun et al. | 254/371 |
| 6,729,606 | B1 | * | 5/2004 | Durin | 254/395 |
| 7,274,853 | B2 | * | 9/2007 | Raz | 385/137 |
| 2001/0008279 | A1 | * | 7/2001 | Kiviniitty | 254/335 |
| 2005/0017228 | A1 | * | 1/2005 | Werner | 254/278 |
| 2008/0302289 | A1 | * | 12/2008 | Mann | 114/102.1 |

* cited by examiner

AXIAL DISPLACEMENT DEVICE, LINE DEPLOYMENT SYSTEM, AND A METHOD FOR DEPLOYING A LINE

CROSS-REFERENCE TO RELATED APPLICATIONS

This application is the National Stage of International Application No. PCT/NL2008/000195, filed Aug. 22, 2008, which claims the benefit of U.S. Provisional Application No. 60/957,832, filed Aug. 24, 2007, the contents of which is incorporated by reference herein.

FIELD OF THE INVENTION

The present invention relates to an axial displacement device for a rotary winch device. Further, the invention relates to a line deployment system for the deployment of a line, for instance a mooring line or an umbilical in the offshore industry as well as a method for deploying a line.

BACKGROUND OF THE INVENTION

Conventionally rotary winches have a single drum to store the rope and to apply the required force to the rope. This type of winch is commonly used for the installation of mooring lines. A mooring line may be a steel spiral strand wire, a polyester line or any other line of suitable material. Another application of rotary winches is for the installation of umbilicals. In the text the term "line" is used for any kind of elongate member which can be used on a winch.

In current practise of offshore applications, lines are transported from shore to an installation vessel on so called storage drums. These are drums that in general have a diameter that is minimized for the type of line that is transported in order to achieve the most efficient and compact way for storage and transportation purposes. Since there is only limited tension in the lines using a small diameter drum for this purpose is no problem. Also the line can be spooled on the storage drum in multiple layers. Interaction between layers is small since the tension in the line is small.

After arrival on the installation vessel the line is spooled on a larger winch drum for installation. This larger winch is referred to as the mooring line deployment winch. During installation high tensions may occur in the line.

The mooring line deployment winch is normally used to lower and pick up lines to or from the bottom of the sea with the installation vessel. During installation of these lines it is preferred to load only a single layer on the drum. When more layers are used, locally very high tension in multiple layers can occur. The top layer may force itself in between lower layers, especially at the flanges, where the top layer transits to a lower layer. Also, because of the winding on the drum there will be points where the top layer has very small contact area with only one cable of the lower layer, thereby introducing very high tensions in both layers. This can cause damage to the line during unreeling.

Due to the increasing water depths in which these lines have to be installed, the situation arises that the lines which have to be deployed by the mooring line deployment winch become too long to fit in a single layer on the drum.

It is remarked that systems are known which are configured to guide spooling wires in multiple layers so that the different layers are positioned in the most suitable manner on top of each other. A well known example for such a system is the so called Lebus groove. Reference is made to patent U.S. Pat. No. 2,620,996. Although such systems have proven to work, in practise the local tensions occurring in the line may reach unacceptable levels, for instance when fibre ropes are being handled. Moreover, the length of the line to be used in conjunction with these systems is limited.

SUMMARY OF THE INVENTION

It is desirable to provide a system and method for deployment of a line in which one or more of the above drawbacks are avoided.

An aspect of the invention provides an axial displacement device to be used in conjunction with a winch, said winch being rotatable about an axis of rotation, said axial displacement device to be arranged stationary with respect to said winch and comprising one or more guiding elements, said one or more guiding elements being configured to displace a winding of said line in a direction parallel to said axis of rotation with at least the diameter of said line, so that a part of the winding being in contact with said winch runs in a plane substantially perpendicular to the axis of rotation.

As the part of the winding being in contact with the winch runs in a plane substantially perpendicular to the axis of rotation, the respective winding will substantially remain at the same location when the line is spooled from or on the drum of the winch. This has the advantage that the windings do not run towards one of the flanges, therewith avoiding the need to stop the process. As a result, the length of the line to be lowered or picked up is independent of the winch.

An aspect of the invention provides a line deployment system for deployment of a line, said winch system comprising:

- a spooling winch configured to at least partially support said line;
- a rotary deployment winch comprising a drum rotatable about an axis of rotation;
- and a axial displacement device to cooperate with said deployment winch, wherein, during use, said line comprises one or more deployment windings on said deployment winch and axial displacement device, and wherein said axial displacement device displaces each of said one or more deployment windings in a direction parallel to said axis of rotation with at least the diameter of said line, so that a part of each winding being in contact with said drum runs in a plane perpendicular to said axis of rotation.

The displacement device according to the invention is in particular useful in combination with a spooling winch and a deployment winch. The spooling winch may be configured to hold a line in multiple layers. In order to have an efficient storage of the line on the spooling winch, the diameter may be small. Before the line is loaded, a number of windings are winded around the combination of the deployment winch and the axial displacement device. As the axial displacement device is configured to displace each winding in a direction parallel to said axis of rotation with at least the width of said line, a part of each deployment winding is in contact with the cylindrical surface of said deployment winch runs in a plane perpendicular to said axis of rotation. With this arrangement, the line may be directly spooled from the spooling winch via the combination of deployment winch and axial displacement device. As the location of the line on the deployment winch remains substantially the same, the length of the line is not limited by this arrangement.

An aspect of the invention provides a method for deployment of a line comprising:

spooling the line from a spooling winch, winding one or more deployment windings on a combination of a deployment winch and an axial displacement device, said deployment winch being rotatable about an axis of rotation and deploying said line, wherein each of said deployment windings is displaced by said axial displacement device in an axial direction parallel to said axis of rotation with at least a width of said line, so that a part of each of the windings being in contact with said winch, runs in a plane substantially perpendicular to the axis of rotation.

BRIEF DESCRIPTION OF THE DRAWINGS

The invention will now be further elucidated whereby reference is made to the appended drawings in which.

DETAILED DESCRIPTION OF A PREFERRED EMBODIMENT

Figure 1B:
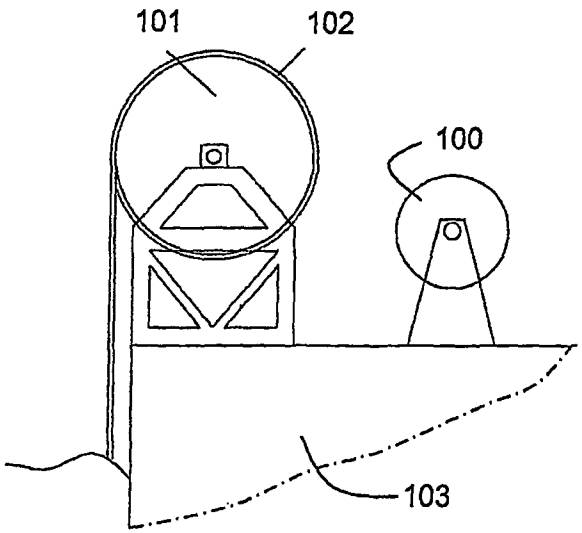
Figure 1b (Prior Art)
FIGS. 1*a* and 1*b* show a prior art configuration for mooring line deployment.
Figure 1A:
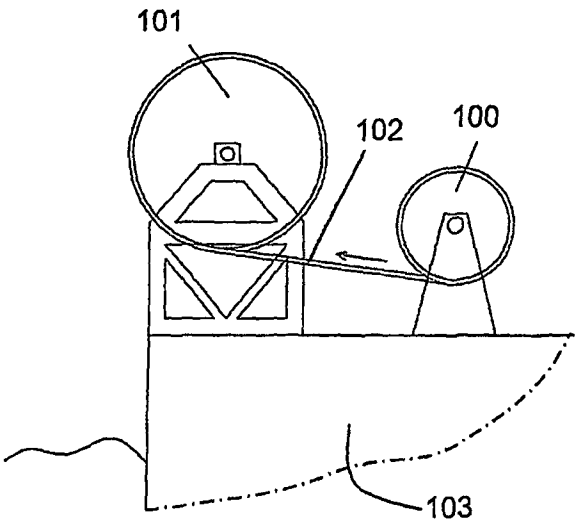
Figure 1a (Prior Art)

FIGS. 1*a* and 1*b* show a conventional line deployment system for deployment of a mooring line. The system comprises a spooling winch 100 and a mooring line deployment winch 101. Deployment of a line 102 with the conventional line deployment system basically consists of two steps. In a first step shown in FIG. 1*a*, the line loaded on the spooling winch 101 is spooled under relatively low tension from the spooling winch 100 on the deployment winch 101. After the whole line 102 has been loaded on the deployment winch 101, the line may be deployed under high tension as shown in FIG. 1*b*, for instance by rotating the drum of the deployment winch 101.

The deployment winch 101 may for instance be used to lower and pick up mooring lines from the bottom of the sea with an installation vessel 103. During installation of these lines it is preferred to load only a single layer on the drum. When more layers are used, very high tensions in multiple layers can occur. The top layer may force itself in between lower layers, especially at the flanges, where the top layer transits to a lower layer. Also, because of the winding on the drum there will be points where the top layer has very small contact area with only one cable of the lower layer, thereby introducing very high tensions in both layers. This can cause damage to the line during unreeling.

Due to the increasing water depths in which these lines have to be installed, the situation arises that the lines which have to be deployed by the mooring line deployment winch become too long to fit in a single layer on the drum.

Figure 2:
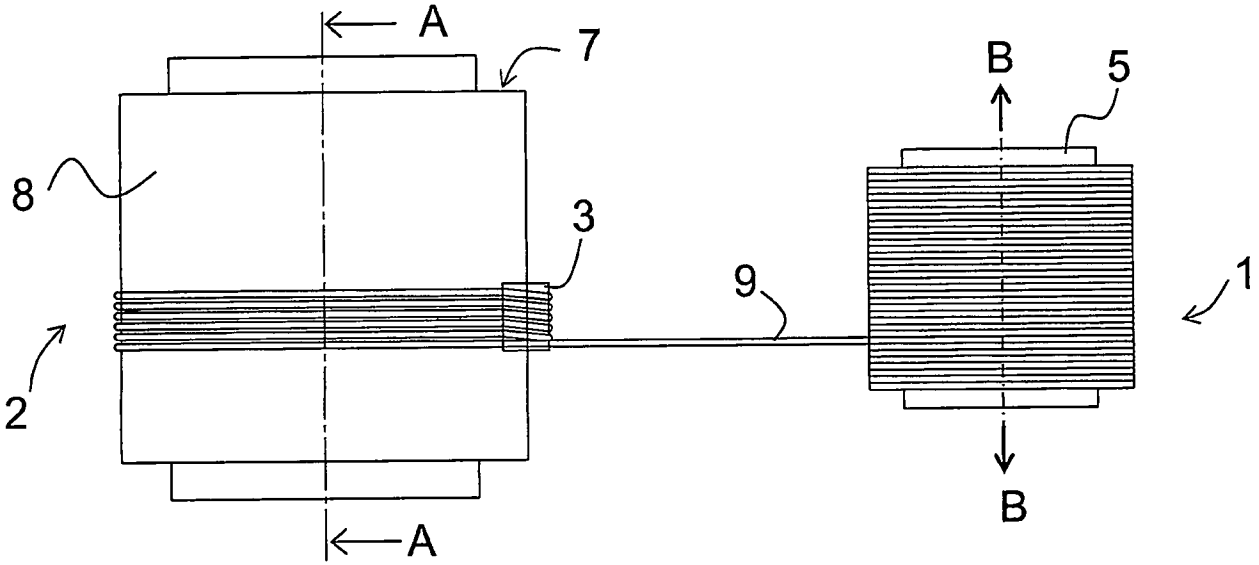
FIG. 2 shows a top view of a line deployment system according to the present invention.
Figure 3:
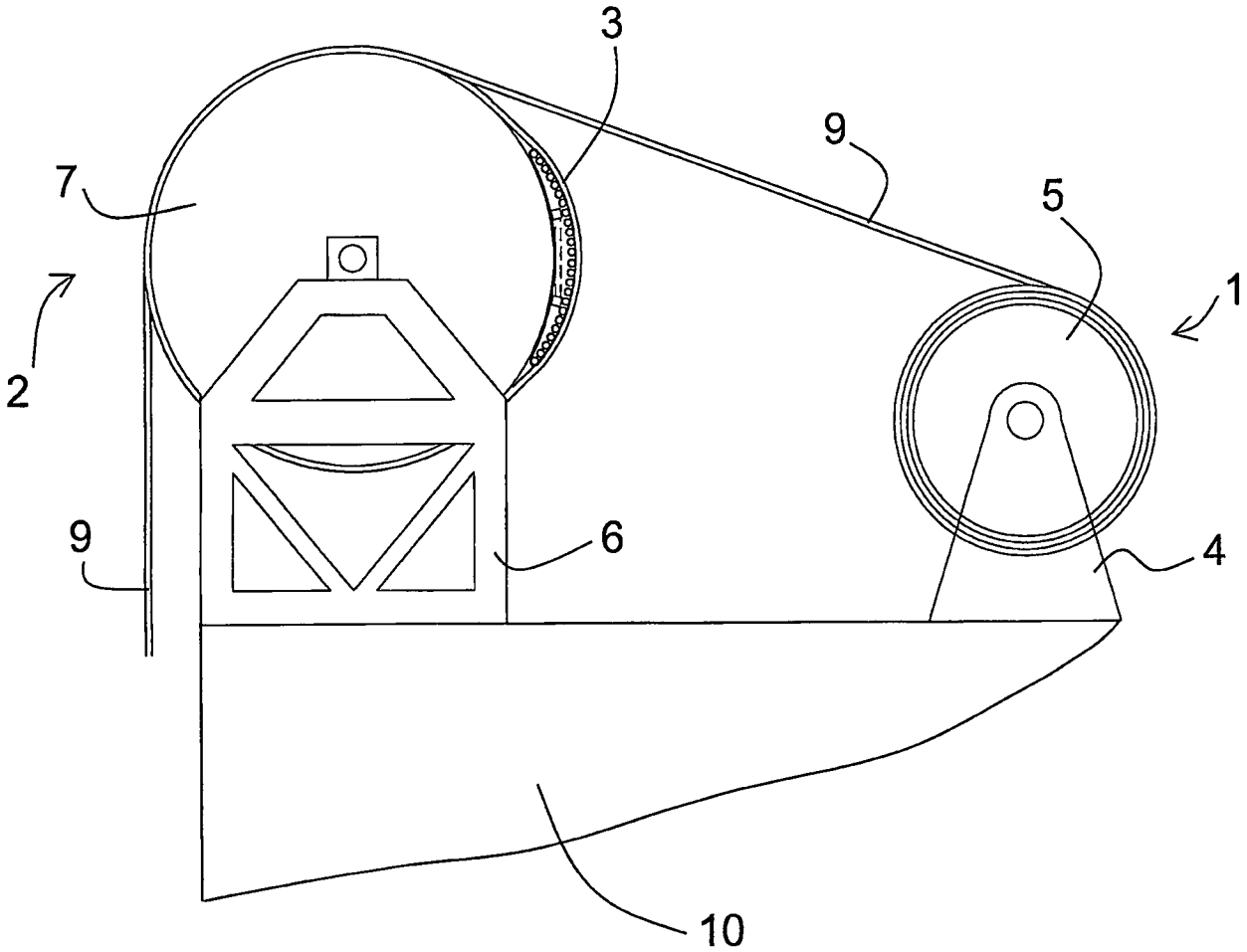
FIG. 3 shows a side view of the line deployment system of FIG. 2.

FIGS. 2 and 3 show an embodiment of a line deployment system according to the invention. The system of the invention comprises a spooling winch 1, a deployment winch 2 and an axial displacement device 3. The spooling winch 1 and the deployment winch 2 are mounted on for instance a vessel 10. The axial displacement device 3 may be mounted on the deployment winch 2, or a separate support structure placed on for instance a vessel 10.

The spooling winch 1 comprises a support 4 and a spooling drum 5 which is rotatably supported by said support 4. The deployment winch 2 comprises a support 6 and a deployment drum 7 which is rotatably supported by said support. The drum 7 is rotatable about an axis of rotation A-A. The drum 7 comprises a cylindrical surface 8 along which a line which is winded on said drum 7 will run.

At least one of the spooling winch 1 and the deployment winch 3 may comprise an actuation device such as an electro, hydraulic or pneumatic motor (not shown) to actuate the rotating movement of the respective drum 5, 7.

The axial displacement device 3 is arranged adjacent to said deployment winch 2, in particular close to the cylindrical surface 8 of said drum 7. A line 9 may be wound about said drum 7 and said axial displacement device 3. Generally, a winding will comprise a part which runs along the cylindrical surface 8 of the drum 7 and a part which runs along the axial displacement device 3.

The axial displacement device 3 is configured to displace a winding of said line 9 in an axial direction, i.e. parallel to the axis of rotation A-A. This displacement is over a distance in the axial direction which is at least the diameter of the line 9. As a result, the part of said winding being in contact with the drum 7 may run in a plane substantially perpendicular to the axis of rotation. Therefore, during deployment each winding may remain at its location and not move in the axial direction to the end of the drum.

A line 9 may be deployed using the following steps spooling the line from a spooling winch, winding one or more deployment windings on a combination of a deployment winch and an axial displacement device, said deployment winch being rotatable about an axis of rotation and deploying said line, wherein each of said deployment windings is displaced by said axial displacement device in an axial direction parallel to said axis of rotation with at least the diameter of said line, so that a part of each of the windings being in contact with said winch, runs in a plane substantially perpendicular to the axis of rotation.

The method of this invention uses the deployment drum 7 no longer to store the line, but as a traction winch. Most of the line is kept on the spooling winch 1. Due to the low tension in the wire on this winch 1, multiple layers are acceptable during transportation and installation, even when the diameter of the drum 5 is small compared to the diameter of the drum 7 of the deployment winch 2.

The end of the line is wound in a limited number of windings, i.e. loops, preferably at least five around the combination of deployment drum 7 and axial displacement device 3. The spooling winch 1 applies a predetermined constant backtension to the line 9. On the other side at the lowered end of the line a force is applied for instance from the weight of steel connection pieces installed at the end of the line 9. This force will increase due to the weight of the line when the line is lowered. The tension in the line gradually decreases over the windings from the high tension at the lowered end to the relatively low backtension at the side of spooling winch.

When the drum 7 starts to rotate the line is lowered on one end and loaded on the deployment winch 2 from the spooling winch 1 on the other end. When the axial displacement device 3 would not be present in this configuration the windings would move axially to one end of the drum and the process must be stopped, since the wire would get stuck between the flange and the following windings.

By using the axial displacement device 3 the windings on the deployment drum 7 and axial displacement device 3, remain at the same location or at least at the same position with respect to the line coming from the spooling winch 1. It may be possible that the windings will move together with the line coming from the spooling winch 1, since this location will move as the line is unreeled from the spooling winch 1. In an alternative embodiment the spooling winch may be moved along in axial direction, i.e. parallel to the axis of rotation, (indicated with arrows B in FIG. 2), so that the location of the line 9 coming from the spooling winch 1 remains constant. In both embodiments the part of the windings running along the cylindrical surface of the drum 7 will remain substantially in a plane perpendicular to the axis of rotation A-A.

An important advantage of the device and method of the present invention is that the line length is no longer restricted by the dimensions of the deployment drum 7. Furthermore, since only a small part of the drum surface is used it further creates the possibility to unreel two or more lines in parallel if two or more axial displacement devices 3 are applied, or windings of two or more lines are applied on a single axial displacement device 3.

Figure 5:
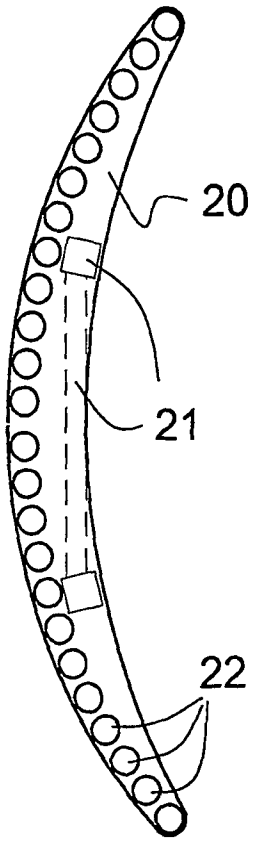
FIG. 5 shows a side view of the axial displacement device of FIG. 4.
Figure 4:
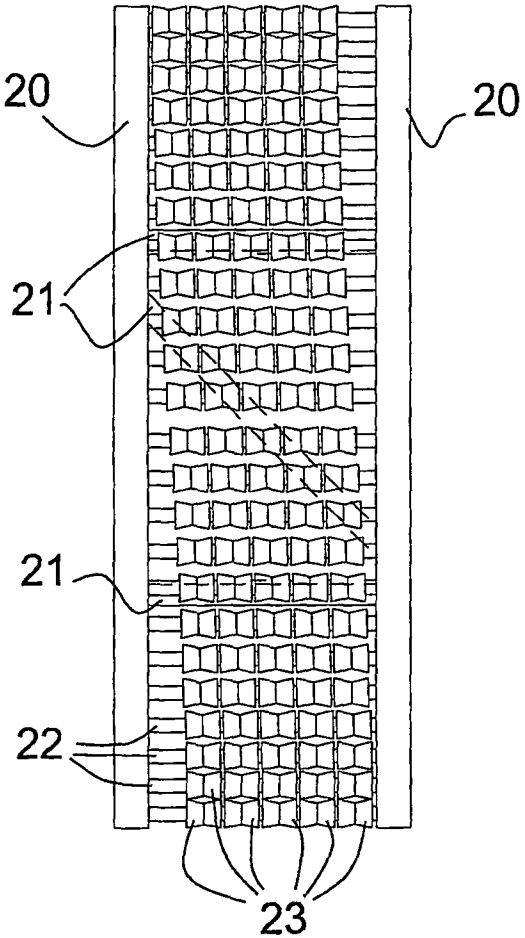
FIG. 4 shows a plan view of the axial displacement device of the present invention.

FIGS. 4 and 5 show an embodiment of an axial displacement device 3 in more detail. The axial displacement device 3 comprises side beams 20 which are mounted on a frame 21. Between the beams 20 a number of shafts 22 are mounted. Each shaft carries a number of guiding elements 23; FIG. 4 shows five elements per shaft.

The guiding elements 23 are rotatably supported on the respective shaft 22. The beams 20 may have a curved shape, for instance a banana shape, so that they can be positioned close to the cylindrical surface of the drum 7. Each guiding element 23 may have a diabolical shape so that a line 9 lying against this guiding element 23 will be guided due to the shape of the guiding element 23. Any other shape capable of guiding the line 9 may also be used including rotatable roller elements or stationary guiding elements such as grooves or channels.

The axial displacement device 3 may be made of any suitable material. The beams 20, the frame 21, and the shafts 22 are preferably made of steel, while the guiding elements 23 are preferably made of steel or plastics material.

All first guiding elements 23 on the consecutive shafts 22 form a row of guiding elements, which may guide a line 9 along the axial displacement device 3 while displacing the line 9 in an axial direction. For this reason the guiding elements 23 on consecutive shafts are gradually shifted. All second, third, fourth and fifth guiding elements 23 on consecutive shafts 22 form a second, third, fourth and fifth row of guiding elements, respectively. Each of these rows is configured to axially displace a part of a winding over at least the distance of the diameter of the line.

Each of the rows with guiding elements 23 preferably has an S-shape when viewed in vertical direction to obtain a gradual axial displacement of a winding. Any other shape of the row, such as a straight line may also be applied.

Preferably at least five rows of guiding elements are provided so that five preferably adjacent windings can be guided over the axial displacement device.

The above described combination of spooling winch 1, deployment winch 2, and axial displacement device 3 has the advantage that the line length which can be used is independent of the size of the drum 7 of the deployment winch 2. Furthermore, as the diameter of the drum 7 may be made large and there is only one layer of deployment windings on the drum 7, the tension on the line may be kept low and controllable. Also, the diameter of the spooling winch may be kept small so that a relative large volume of line may be kept in a small volume, as the tensions in the line on the spooling winch are relative small.

The axial displacement device, the line deployment system and the method for deploying a line are hereinabove described for a line deployment system on an offshore vessel, but may be used in any suitable application wherein a line under tension is spooled from a winch.

What is claimed is:

1. An axial displacement device to be used in conjunction with a rotary winch, said winch comprising a drum being rotatable about an axis of rotation, said axial displacement device to be arranged stationary with respect to the axis of rotation of said drum and comprising one or more guiding elements, wherein, at least one winding of a line is to be arranged around said drum and said one or more guiding elements of said axial displacement device, a part of the at least one winding being in contact with said drum and a part of the at least one winding being disengaged from the drum and in contact with the one or more guiding elements;

wherein said part being in contact with said drum extends from a first disengaged part of the winding to a second disengaged part of a next winding; and wherein said one or more guiding elements are configured to displace the part of said at least one winding of the line which is disengaged from the drum in a direction parallel to said axis of rotation by a distance of at least the diameter of said line, so that the entire part of said winding being in contact with said drum runs in a plane perpendicular to the axis of rotation.

2. The device of claim 1, wherein said one or more guiding elements are rotatably mounted on a frame.

3. The device of claim 1, wherein for each winding a row of guiding elements is mounted on a frame, said guiding elements being arranged to gradually displace said winding in said direction.

4. The device of claim 1, wherein said guiding elements have a diabolo shape.

5. The device of claim 1, wherein said device comprises a frame having a number of shafts each shaft comprising a guide element for a consecutive winding.

6. Line deployment system for deployment of a line, said deployment system comprising:

a spooling winch configured to at least partially support said line;

a rotary deployment winch comprising a drum rotatable about an axis of rotation; and an axial displacement device to cooperate with said deployment winch, wherein, during use, said line comprises one or more deployment windings around said deployment winch and said axial displacement device, a part of said one or more deployment windings being in contact with the drum and a part of said one or more deployment windings being disengaged from the drum and being in contact with the axial displacement device;

wherein said part being in contact with said drum extends from a first disengaged part of the winding to a second disengaged part of a next winding; and wherein said axial displacement device displaces each part of said one or more deployment windings which is disengaged from the drum in a direction parallel to said axis of rotation by a distance of at least the diameter of said line, so that the entire part of each winding being in contact with said drum runs in a plane perpendicular to said axis of rotation.

7. The system of claim 6, wherein the axial displacement device is mounted stationary with respect to the axis of rotation of the drum of the rotary winch when said entire part of said winding is contacting said drum.

8. The system of claim 6, wherein one or more said guiding elements are rotatably mounted on a frame.

9. The system of claim 6, wherein for each winding a row of guiding elements is mounted on a frame, said guiding elements being arranged to gradually displace said winding in said direction.

10. The system of claim 6, wherein said guiding elements have a diabolo shape.

11. The system of claim 6, wherein said device comprises a frame having a number of shafts each shaft comprising a guide element for a consecutive winding.

12. The system of claim 6, wherein said axial displacement device is mounted on a stationary part of said deployment winch.

13. The system of claim 6, wherein said axial displacement device is mounted on a support frame.

14. The system of claim 6, wherein said spooling winch comprises a rotary spooling drum having a diameter smaller than a diameter of said drum of said deployment winch.

15. A method for deployment of a line comprising:

spooling the line from a spooling winch, winding one or more deployment windings around a combination of a deployment winch and an axial displacement device, wherein a part of the one or more deployment windings is in contact with the deployment winch and a part of said one or more deployment windings is disengaged from the deployment winch and is in contact with the axial displacement device, where said part being in contact with said deployment winch extends from a first disengaged part of the winding to a second disengaged part of a next winding, said deployment winch being rotatable about an axis of rotation, and deploying said line, wherein each part of said deployment windings which is disengaged from the drum is displaced by said axial displacement device in a direction parallel to said axis of rotation by a distance of at least the diameter of said line, so that the entire part of each of the deployment windings being in contact with said deployment winch, runs in a plane perpendicular to the axis of rotation.

16. The method of claim 15 further comprising maintaining said axial displacement device stationary with respect to said axis of rotation of said deployment winch while performing the step of deploying said line via one or more deployment windings around a combination of the deployment winch and the axial displacement device.

* * * * *